US007018227B2

(12) United States Patent
Takahashi

(10) Patent No.: US 7,018,227 B2
(45) Date of Patent: Mar. 28, 2006

(54) CARD CONNECTOR DEVICE

(75) Inventor: Kei Takahashi, Kanagawa (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/830,008

(22) Filed: Apr. 23, 2004

(65) Prior Publication Data

US 2004/0235354 A1 Nov. 25, 2004

(30) Foreign Application Priority Data

Apr. 24, 2003 (JP) ..... 2003-119398

(51) Int. Cl.
*H01R 4/50* (2006.01)

(52) U.S. Cl. ..... 439/347; 439/327; 439/945

(58) Field of Classification Search ..... 439/327, 439/347, 638, 945
See application file for complete search history.

(56) References Cited

U.S. PATENT DOCUMENTS 6,264,506 B1 * 7/2001 Yasufuku et al. ..... 439/638

FOREIGN PATENT DOCUMENTS

| | | |
|---|---|---|
| JP | 08-185929 | 7/1996 |
| JP | 08-250208 | 9/1996 |
| JP | 3080713 | 7/2001 |

* cited by examiner

*Primary Examiner*—Khiem Nguyen
(74) *Attorney, Agent, or Firm*—Banner & Witcoff, Ltd.

(57) ABSTRACT

A card connector device comprising: a case 11 having a card slit port 19 capable of inserting hereinto a functional card having a terminal, and accommodating an internal connector 15 for card holding the functional card to be inserted and comprising a terminal 15*b* to be connected electrically with the terminal of the functional card; an external connector 17 provided protrusively on the case apart from the card slit port 19 and connected electrically with the internal connector for card; and a card stopper 20 located as being capable of sliding between the card slit port 19 of the case and the external connector, and comprising a first end 20*b* at the card slit port side and a second end 20*c* capable of protruding toward the external connector side; wherein the first end 20*b* clutches the functional card 14 when the card stopper 20 moves to the card slit port 19 side to suppress the functional card being pulled out of the card slit port, and the second end 20*c* protrudes in the protrusively provided direction of the connector 17 from the second edge 20*c* when clutching of the functional card 14 at the card slit port 19 is released.

10 Claims, 4 Drawing Sheets

CARD CONNECTOR DEVICE

FIELD OF THE INVENTION

This invention relates to a card connector device into which a functional card e.g. a memory card is inserted, to connect directly the functional card with a connector port of an external apparatus such as a computer through a connector without using a cord.

BACKGROUND OF THE INVENTION

An interface e.g. a universal serial bus (USB) or a parallel/serial interface connecting a main body of a personal computer (hereinafter called PC) with an external device can function by inserting a connector provided on the end of the interface into a port of the PC side through a cord connected with the external device. Meanwhile, IC cards such as memory cards are directly connected with a PC by inserting the cards into the PC with providing a dedicated connector port therefor on the PC side. However, there are many kinds of memory cards having different specifications, for example, SMART MEDIA, SD CARD, COMPACT FLASH, XD Card, and MEMORY STICK (all of them are trade names). Because the shape and the terminal structure are different with respect to each memory card type, providing a terminal corresponding to every card type on the PC body makes the structure thereof complicated. Therefore, a card connector device, which can correspond to any card type by connecting an external card reader dedicated to a particular card with a multipurpose interface port of the PC side, has been put into practical use.

When connection is carried out through cords, the cords make the area of the PC complex. Therefore, a cordless connection method was proposed (Registered Japanese Utility Model No. 3080713). This is a structure of a card reader integrated with a USB plug-in receptacle (connector) to eliminate any cords, where the card reader is mechanically attached to a connector port of the PC body through the plug-in receptacle. The structure has an effect that can clear up the area of the PC because it has no cords.

Card-type peripheral devices such as PC cards (including HDD installed) or wireless LAN cards have recently increased in number.

It is however unavoidable that the device protrudes from the PC body when the card connector device for these cards is put in the PC, so that things in the periphery thereof or human hands may touch it accidentally. The card reader has a card slit for inserting a card thereinto, whereby the terminal of the card is connected with the inner terminal inside the reader when the card is inserted into the slit. In the case of the pop-up structure that alternates between a 'contact' state and a 'non-contact' state with every pushing of the card, the accidental touching mentioned above may result in the card being ejected. Moreover, because the card can be pulled out arbitrarily from the reader, there is a possibility that the information in the card will be damaged due to accidental ejection of the card while the reader is operating.

SUMMARY OF THE INVENTION

The present invention is intended to ensure insertion of the functional card by overcoming the drawbacks mentioned above and thereby to obtain a card connector device that prevents the card from being ejected accidentally while it is operating.

In accordance with an embodiment of the invention, a card connector device comprises:

a case having a card slit port capable of inserting thereinto a functional card having a terminal, and accommodating an internal connector for card holding the functional card to be inserted and comprising a terminal to be connected electrically with the terminal of the functional card;

an external connector provided protrusively on the case apart from the card slit port and connected electrically with the internal connector for card and;

a card stopper located as being capable of sliding between the card slit port of the case and the external connector, and comprising a first end at the card slit port side and a second end capable of protruding toward the external connector side; wherein the first end clutches the functional card when the card stopper moves to the card slit port side to suppress the functional card being pulled out of the card slit port, and the second end protrudes in the protrusively provided direction of the connector from the second edge when clutching of the functional card at the card slit port is released.

Furthermore, according to another embodiment of the invention, a card connector device comprises:

a case comprising at least a first edge having a card slit port for inserting thereinto a functional card and a second edge extending in a direction crossing the first edge and having a projecting connector port;

a circuit board located in the case and connected electrically with the functional card to be inserted into the card slit port;

a connector connected with the circuit board and a part thereof protruding from the projecting connector port toward the outside of the case; and a card stopper located adjacent to the projecting connector port on the first edge, being capable of sliding between the card slit port and the second edge, and having a first end on the card slit port side and a second end on the second edge side; wherein the first end clutches a side edge or a notch of the functional card when the card stopper moves to the card slit port side to suppress the functional card being pulled out of the card slit port, and the second end protrudes in the protrusively provided direction of the connector from the second edge when clutching of the functional card at the card slit port is released.

According to these embodiments, the card stopper prevents the functional card inserted into the card slit port from being accidentally ejected, and thereby can ensure reliability of information processing while the card is operating.

In this case, it is desirable that the second end of the card stopper should be pushed by the PC body on the condition that the connector is inserted into the connector port of the PC body side with which the connector is connected, and that the first end of the card stopper should protrude toward the card slit port side. Because the second edge of the case is in contact with or adjacent to the body wall or the periphery of the port when the card connector device is inserted into the PC body, the first end thrusts into the card slit port by adjusting the length of the card stopper when the second end is pushed by the PC body. In consequence, the card stopper prevents the card from being pulled out because the card stopper pushes the inserted functional card when the connector is inserted into the PC body. Therefore, while the card connector device is mounted on the PC body, the functional card is prevented from being ejected from the device to assure reliable operation thereof.

In addition, the card stopper prevents the functional card from popping out when the first end of the card stopper clutches the back side edge of the functional card inserted into the card slit port.

In the case of the functional card having a notch on the side edge thereof, it is desirable that an arm portion extending to and clutching the notch of the functional card should be provided on the first end of the card stopper. The arm portion can correspond to the position of the notch of the functional card by positioning the end of the arm portion on another line parallel to the sliding line of the card stopper by being bent.

The connector is preferably fixed directly to the circuit board. Fixing directly the base of the connector to the circuit board with, for example, solder, the circuit board and the connector can unify to be treated as a single part, and thereby mechanical structure thereof becomes simple. The structure of the card connector device becomes so simple that production thereof can be facilitated.

In the above mentioned second embodiment, the card stopper is preferably held so as to be movable in the extending direction of the first edge by means of a rail formed on the first edge.

It is further preferable that the rail has a click projection to restrict movement of the card stopper.

The case is preferably formed with two divided cases combined together, and a frame of first edge of each divided case has preferably a rail and a rail groove, both of which hold slidably the stopper.

Here the functional card is a card such as a memory card, a wireless LAN card, or a PC card, which raises function of the PC in cooperation with the PC.

The card connector device is a device coupling these functional cards with the PC body. For example, the card reader for the memory card corresponds thereto.

The external connector is a male connector such as the USB or the parallel/serial interface, which is inserted into a port having an external connector receptacle of an external device like the PC.

DETAILED DESCRIPTION OF THE PREFERRED EMBODIMENTS

Referring to FIG. 1 to FIG. 4, the first embodiment where the present invention is applied to the card reader for the memory card will be explained.

Figure 1:
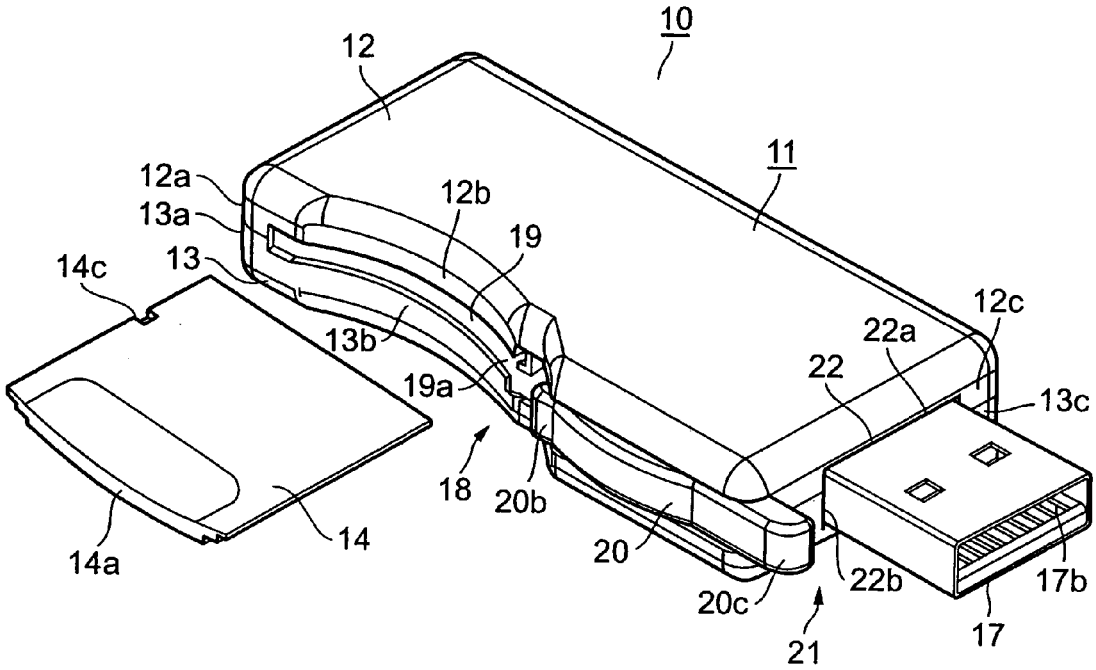
FIG. 1 is a perspective view of the first embodiment of the present invention.
Figure 2:
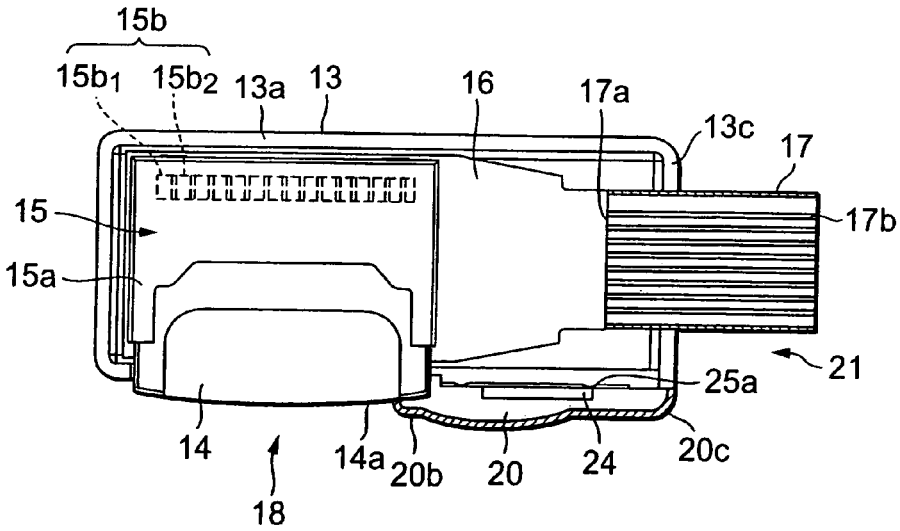
FIG. 2 is a plan view of the first embodiment, where the upper case is removed and a part thereof is cut on the condition that a functional card is loaded, to explain the first embodiment.
Figure 3:
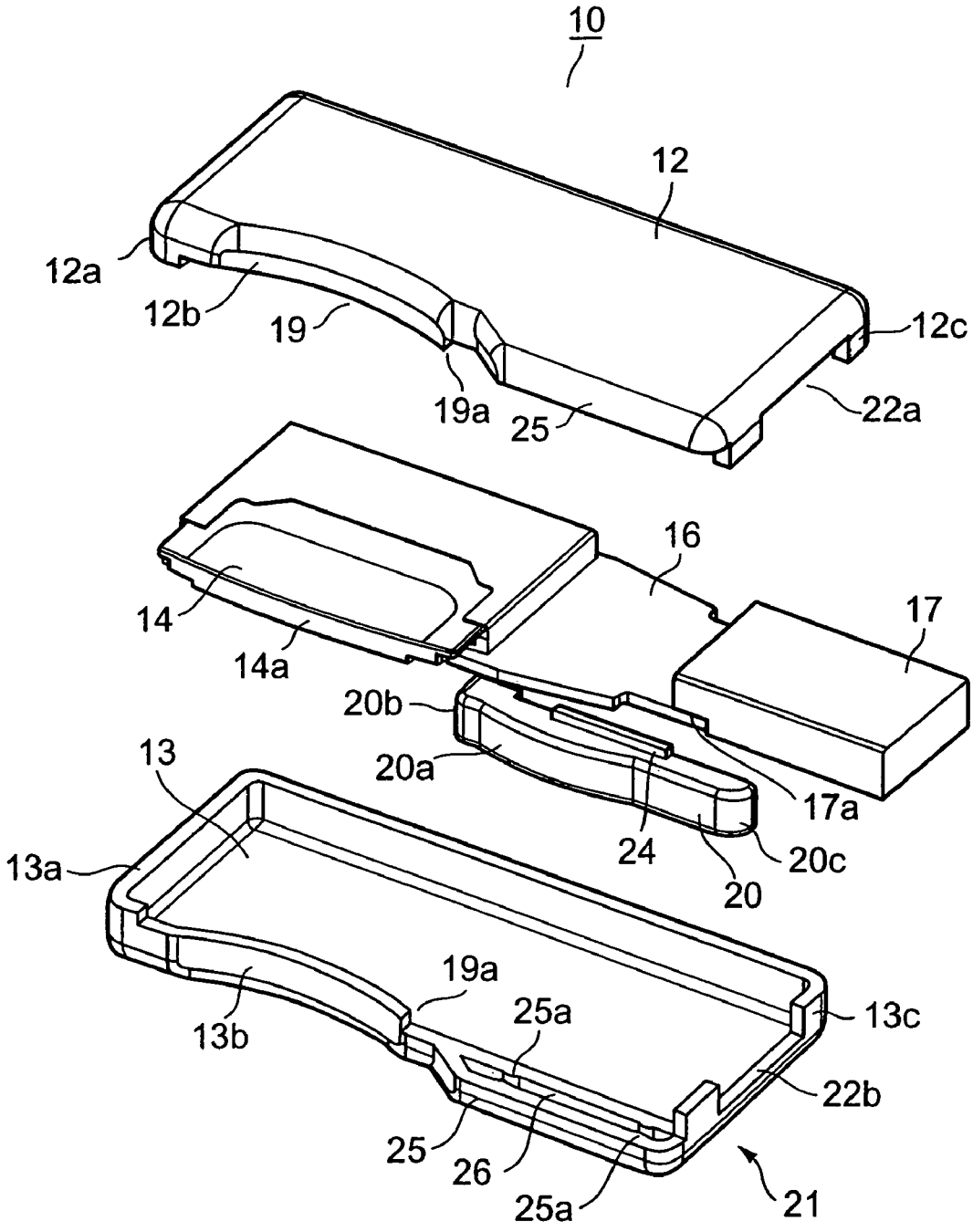
FIG. 3 is a perspective view of the disassembled first embodiment.
Figure 4:
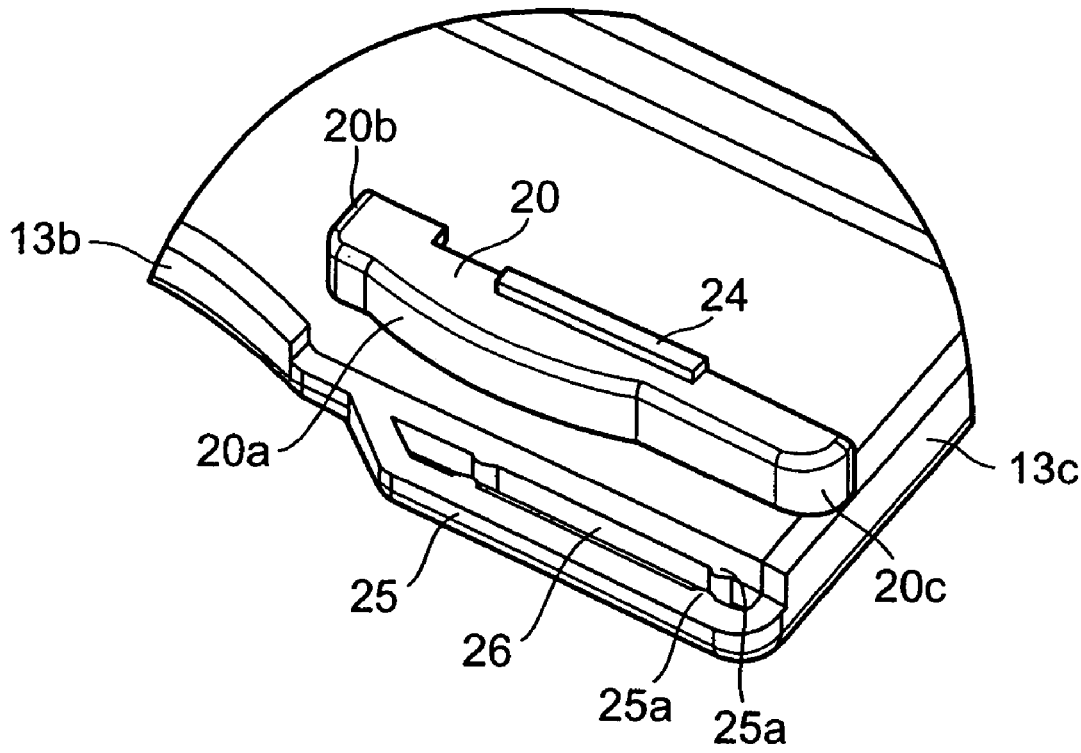
FIG. 4 is a magnified perspective view showing the card stopper portion of the first embodiment.

FIG. 1 shows a perspective view of an interface, i.e. a card connector device of the embodiment before a card is loaded; FIG. 2 shows a plan view in which the upper case is removed; FIG. 3 shows a disassembled perspective view; and FIG. 4 shows a magnified perspective view of the card stopper portion. A case body 11 to be the card housing is made of synthetic resin. An upper case 12 having a frame 12*a* around the periphery thereof and a lower case 13 having a frame 13*a* around the periphery thereof are manufactured separately to be unified thereafter with the two frames brought together to become the case. In the case 11, a metal guide frame 15*a* holding a functional card, e.g. a memory card, at the periphery thereof is attached, and a slightly rectangular circuit board 16 having terminals 15*b* to be connected electrically with the terminals of the card is accommodated. The internal connector terminals 15*b* for the card are formed by arranging linearly elastic pieces 15*b*1, 15*b*2, and so forth whose contact portions are curved like a bow, on an insulative board in parallel with each other. Each elastic piece is an elastic cantilever beam, which pushes elastically the edge of the loaded thin plate-like card. Thereby, the contact portions are in contact with the plurality of the card terminals formed on one surface of the card in parallel pattern. That is to say, the terminals 14*b* (refer to FIG. 5) are in contact with the terminals 15*b* of the internal connector 15 for card when the rectangular card 14 is loaded.

A base portion 17*a* of the external male connector 17 of the USB is mechanically fixed to the other end of the circuit board 16 by soldering, and at the same time, the external connector terminals 17*b* of the USB are connected electrically with a circuit located on the circuit board 16 and coupling the terminals 15*b*.

The upper case 12 and the lower case 13 adhere to each other with the frames 12*a*, 13*a* fitted together accompanied by the circuit board intervening between them, and then the case 11 is formed. The case 11 is a rectangle, which has a card slit port 19 to load the functional card 14 on the first edge 18 (near side of the Figure) and a card stopper 20 adjacent to the card slit port 19 on the same first edge 18. The case frames 12*b* and 13*b* forming the card slit port 19 have a smaller width than that of other side frames 12*a* and 13*a* so that an opening can be formed when the upper and the lower cases are fitted together. The opening becomes the card slit port 19. The frame portions 12*b* and 13*b* are slightly curved inward to facilitate taking out the card. The width and the length of the card slit port are suited to the shape of the functional card to be loaded. If the functional card 14 is the XD card (trade name), longitudinal (card loading direction)× transversal is 20 mm×25 mm. As the thickest portion is 1.7 mm in thickness, the card slit port 19 has a dimension slightly larger than the thickness. A notch 14*c* is provided on the side edge of the functional card 14.

U-shaped notches 22*a* and 22*b* are formed on the frames 12*c* and 13*c* forming the second edge 21 adjacent to and crossing the first edge 18. Fitting the upper case and the lower case together, a protrusively providing port 22 for the USB connector is formed. The external USB connector 17 fixed to the circuit board at the end thereof is held tightly in such a manner as to protrude from the case.

The card stopper 20 to be located on a part of the first edge 18 between the card slit port 19 and the second edge 21 is formed like an elongate rectangular waterspout with a U-shaped cross section, and has a long protrusion 24 on the side portion thereof. Rails 25 and rail grooves 26 form a part of the frames of the upper case and the lower case, both of which constitute the first edge 18. When the upper and the second cases 12 and 13 are fitted together, the side protrusion 24 of the card stopper 20 is pinched by the rails and set in the rail grooves. Therefore, the card stopper 20 is held so as to move along the rail groove though it is not detachable. Moving direction of the card stopper is the direction in which the external connector is protrusively provided on the case. Click protrusions 25*a* are provided at two points in the rail groove to impose some friction on the movement of the card stopper 20. Namely, braking is to be put on the movement of the card stopper at the moving limit points of both the card slit port 19 side and the second edge 21 side, in order that the card stopper cannot move freely. The braking has a degree that manual movement is available. A bulge 20*a* provided on the surface of the card stopper can make movement by operator's fingers smooth.

The first end 20*b* of the card stopper 20 is positioned at the card slit port 19 side, and opens in U-shape. When the card stopper is on the limit point of the slit port side, the first end 20*b* comes face to face with the slit port beyond the end portion 19 of the card slit port. The second end 20*c* of the card stopper of the second edge 21 side is approximately on the same surface as the second edge 21.

The length of the card stopper 21 takes on an important function in this embodiment. When the first end 20*b* retreats from the card slit port 19, the second end 20*c* protrudes from the surface of the second edge 21. Therefore, when the connector 17 is inserted into the port of the PC body, the second end of the card stopper 20 is inevitably pushed by the USB port or the neighboring PC wall. Consequently the card stopper moves along the rail 25 in the direction of the first edge 18, and the first end 20*b* thereof protrudes beyond the end portion 19*a* of the card slit port 19.

In consequence, the back side edge 14*a* of the card is not completely accommodated in the case but sticks out therefrom in the condition that the functional card 14 is completely inserted into the card slit port 19. When the opening portion of the first end 20*b* of the card stopper 20 clutches the corner of the back side edge of the card, which sticks out of the case, the inserted card is locked and never slips off the case. As mentioned above, the card stopper 20 is locked by the PC body and cannot move when the connector 17 of the card reader is inserted into the port of the PC body, so that the functional card 14 cannot be carelessly ejected. In order to take out the card, the card stopper may be moved toward the external connector to unlock in the condition that the connector be removed from the PC.

Figure 5:
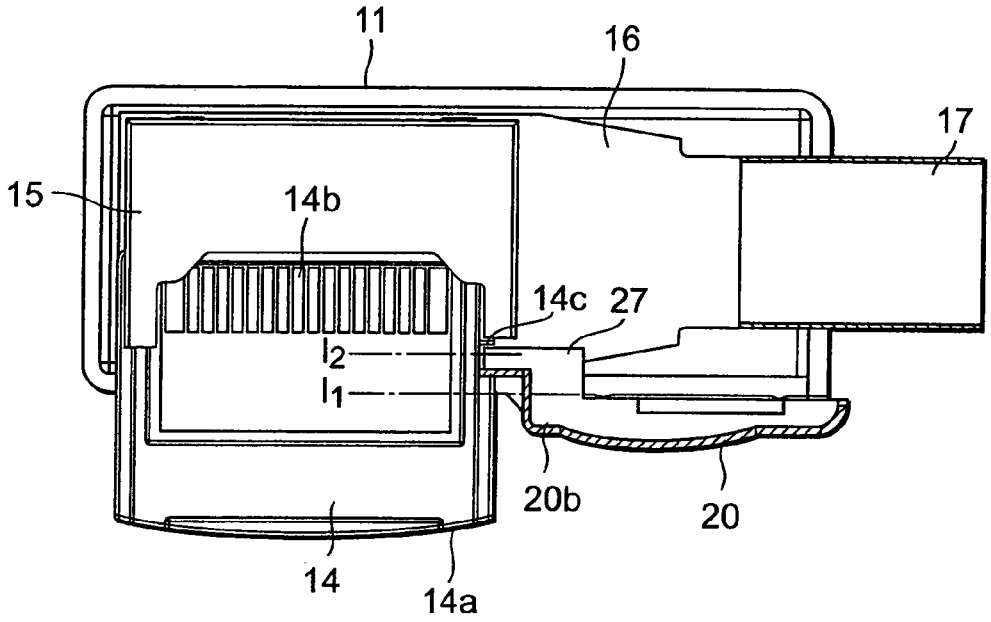
FIG. 5 is a plan view of the second embodiment in which the upper case is removed, and a part thereof is shown in section.

FIG. 5 shows a second embodiment of the present invention.

Some memory cards have a notch on a side edge of the card to function as positioning or a temporary card stopper. As an example thereof, the XD card has a notch 14*c* on one side edge crossing the terminal edge. This embodiment relates to a construction that has some misalignment between the position of the notch and the sliding position of the card stopper. Each part denoted by the same mark as that of FIG. 1 to FIG. 4 is the same part, and the explanation thereof will be omitted.

If the terminals 14*b* are connected with the terminals 15*b* of the card connector device side in the condition that the functional card (e.g., XD card) 14 is shallowly inserted into the case 11 of the card connector device, misalignment is generated between the backside edge 14*a* of the card and the slide line $\mathbf{1}_1$. In the light of the above, an arm portion 27 bending in L-shape is formed on the first end 20*b* of the card stopper 20 in order that the notch 14*c* of the card can clutch the arm portion by moving it along another line 12 parallel to the slide line $\mathbf{1}_1$. Namely, in the case of the construction where aligning the slide line $\mathbf{1}_1$ of the card stopper with the back side edge 14*a* of the functional card is difficult, the clutching position can be changed by forming the arm portion 27. Therefore the clutching position can correspond to various kinds of functional cards.

Figure 6:
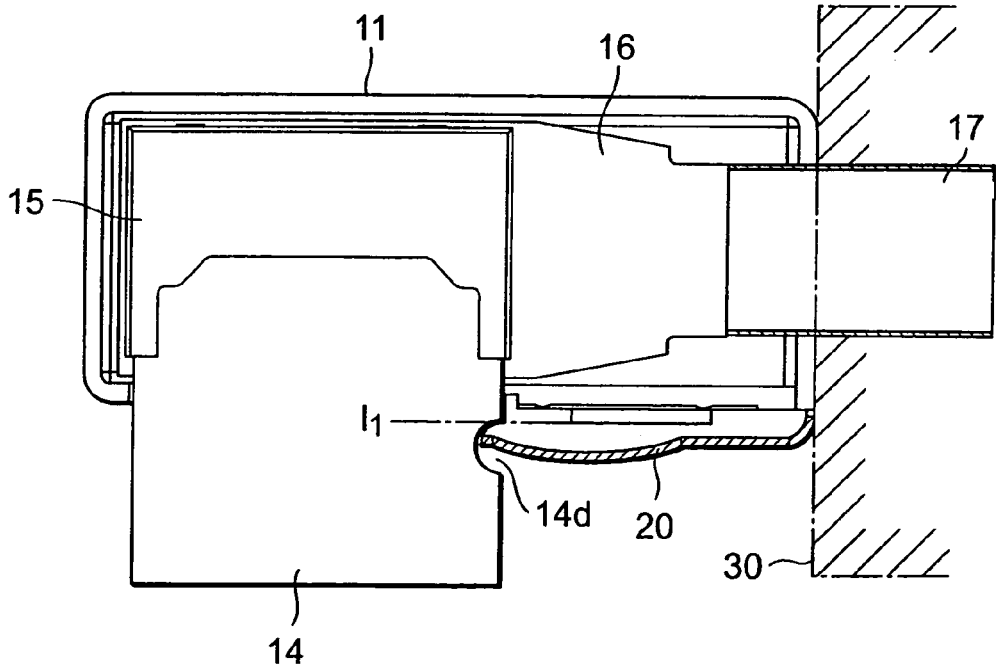
FIG. 6 is a plan view of the third embodiment in which the upper case is removed, and a part thereof is shown in section.

FIG. 6 shows a third embodiment of the present invention.

Because the PC card accommodating HDD has a large size, the case of the card connector device must be made large corresponding thereto.

Although the device can be miniaturized if the connecting terminals of the card are connected with the card connector device at a shallow position, the functional card is easily ejected on the contrary. This embodiment is to adjust the connecting position of the card terminals so that the slide line l of the card stopper can correspond to the notch 14*d* of the card, preventing the card from slipping out or being accidentally ejected by the card stopper 20 clutching the notch 14*d* of the card while the connector 17 is inserted into the PC body 30 as is the case with the first embodiment.

Although the present invention was explained referring to the embodiments mentioned above, the case is not restricted to combining divided cases, but can be a single-piece case. The shape of the case can be arbitrarily selected. Crossing angle between the first edge and the neighboring second edge is preferably the right angle, but not limited thereto. The first edge can be tapered and the second edge can be formed with just the projecting connector port on the top thereof. As the connector, various interfaces other than the USB, for example, the parallel/serial interface can be applied. Furthermore, a plurality of card slit ports can be provided.

The present invention is to attach a card stopper, which prevents a functional card from being loaded or ejected while it is inserted into a PC body, to a card connector device. Therefore, the card connector device can be operated surely thanks to a simple construction.

What is claimed is:

1. A card connector device comprising:

a case having a card slit port capable of inserting thereinto a functional card having a terminal, and accommodating an internal connector for card holding the functional card to be inserted and comprising a terminal to be connected electrically with the terminal of the functional card;

an external connector provided protrusively on the case apart from the card slit port and connected electrically with the internal connector for card; and a card stopper located as being capable of sliding between the card slit port of the case and the external connector, and comprising a first end at the card slit port side and a second end capable of protruding toward the external connector side; wherein the first end clutches the functional card when the card stopper moves to the card slit port side to suppress the functional card being pulled out of the card slit port, and the second end protrudes in the protrusively provided direction of the external connector from the case when clutching of the functional card at the card slit port is released, and the second end is pushed by an external device and the first end protrudes toward the card slit port when the external connector is inserted into a connector receptacle of the external device with which the external connector is connected.

2. A card connector device comprising:

a case comprising at least a first edge having a card slit port for inserting thereinto a functional card and a second edge extending in a direction crossing the first edge and having a projecting connector port;

a circuit board located in the case and connected electrically with the functional card to be inserted into the card slit port;

a connector connected with the circuit board and a part thereof protruding from the projecting connector port toward the outside of the case; and a card stopper located adjacent to the projecting connector port on the first edge, being capable of sliding between the card slit port and the second edge, and having a first end on the card slit port side and a second end on the second edge side; wherein the first end clutches a side edge or a notch of the functional card when the card stopper moves to the card slit port side to suppress the functional card being pulled out of the card slit port, and the second end protrudes in the protrusively provided direction of the connector from the second edge when clutching of the functional card at the card slit port is released, and the second end is pushed by an external device and the first end protrudes toward the card slit port when the connector is inserted into a connector receptacle of the external device with which the connector is connected.

3. The card connector device as stated in claim 2, wherein the second end of the card stopper is pushed by a PC body and the first end of the card stopper protrudes toward the card slit port in the condition that the connector is inserted into the connector receptacle of the PC body with which the connector is connected.

4. The card connector device as stated in claim 2, wherein the first end of the card stopper clutches the back side edge of the functional card inserted into the card slit port.

5. The card connector device as stated in claim 2, wherein the functional card has a notch and the first end of the card stopper comprises an arm portion extending to and clutching the notch of the functional card.

6. The card connector device as stated in claim 2, wherein the connector is directly fixed to the circuit board.

7. The card connector device as stated in claim 2, wherein the stopper is held movable in the extending direction of the first edge by a rail formed on the first edge.

8. The card connector device as stated in claim 7, wherein a click protrusion is provided on the rail to restrict movement of the stopper.

9. The card connector device as stated in claim 2, wherein the case is formed by combining two divided cases, and a frame of first edge of each divided case has a rail and a rail groove to hold the stopper slidably along the rail and the rail groove.

10. A card connector device comprising:

a case having a first edge and a second edge;

a card slit port on said first edge of said case, said card slit port configured to receive a functional card;

an internal connector configured to electrically connect with a functional card when a functional card is inserted in said card slit port;

an external connector on said second edge of said case, said external connector being electrically connected to said internal connector, and configured to mate with a receptacle of an external device;

a card stopper slidably located along said first edge, wherein a length of said stopper is greater than a distance between said card slit port and said second edge, whereby insertion of the card connector device into an external device causes said stopper to slide over a portion of said card slit port.

* * * * *